US008115583B2

(12) United States Patent
Lensky

(10) Patent No.: US 8,115,583 B2
(45) Date of Patent: Feb. 14, 2012

(54) GENERATION OF MULTIPOLAR ELECTROMAGNETIC ENERGY

(76) Inventor: Vasily Lensky, Moscow (RU)

( * ) Notice: Subject to any disclaimer, the term of this patent is extended or adjusted under 35 U.S.C. 154(b) by 724 days.

(21) Appl. No.: 11/599,624

(22) Filed: Nov. 15, 2006

(65) Prior Publication Data

US 2008/0112111 A1 May 15, 2008

(51) Int. Cl.
*H01F 27/28* (2006.01)

(52) U.S. Cl. ..... 336/170

(58) Field of Classification Search ..... 336/170–173, 336/180–184

See application file for complete search history.

(56) References Cited

OTHER PUBLICATIONS

Lensky, A. Kotchnev, "Fundamentals of Multipolarity", Irkutsk University Press 192 p., 1986.

*Primary Examiner* — Tuyen Nguyen
(74) *Attorney, Agent, or Firm* — Dennis Clarke

(57) ABSTRACT

A method and system of generating multipolar electromagnetic energy from bipolar electromagnetic energy, comprising supplying bipolar electromagnetic energy to plural cascades in a bipolar electromagnetic circuit such that at least a portion of said bipolar energy is converted into multipolar energy therein and separating said multipolar energy from other forms of energy produced by said circuit.

13 Claims, 15 Drawing Sheets

Spherical oscillating circuit for Lensky "X-polar" waves formation.

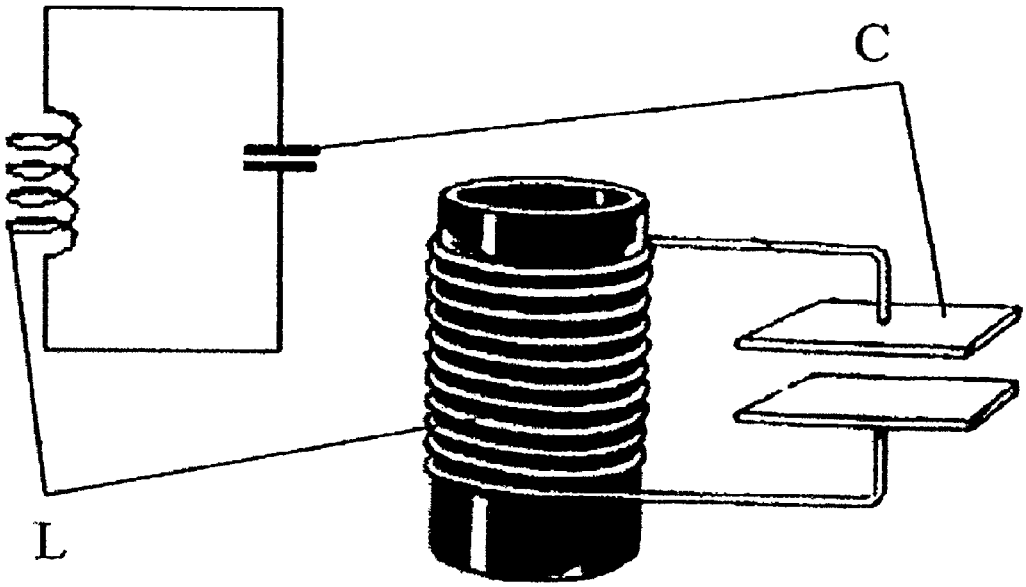
Fig.1. Two-polar oscillating circuit.
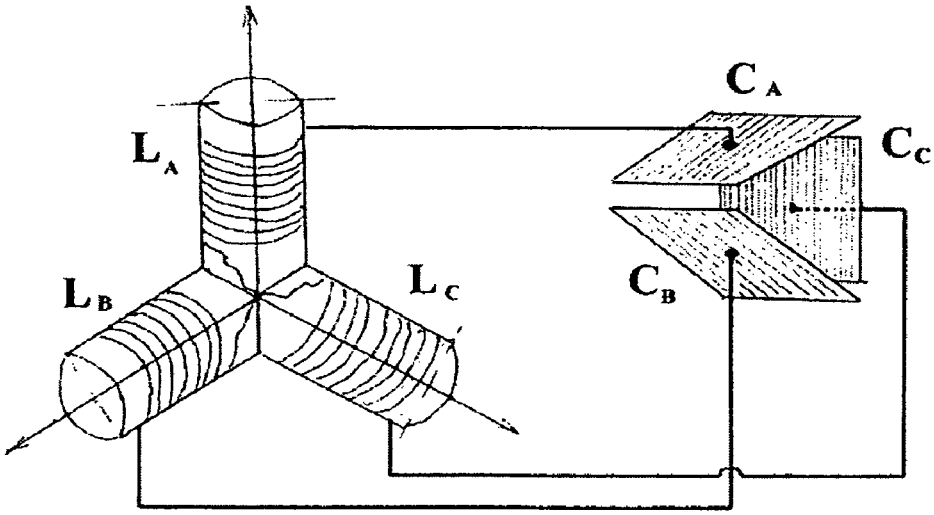
Fig.2. Three-polar Lensky oscillating circuit.

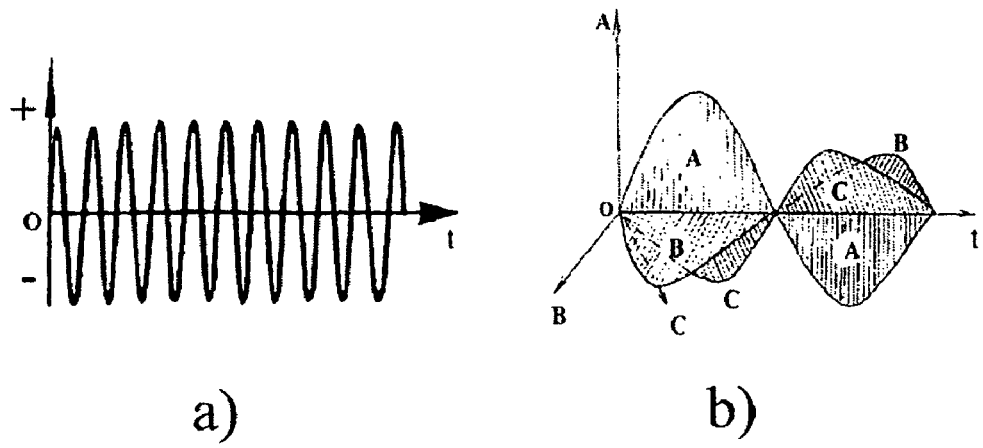
Fig. 3. Graphic representation of Maxwell *two-polar* electromagnetic wave (a) and Lensky *three-polar* wave (b).
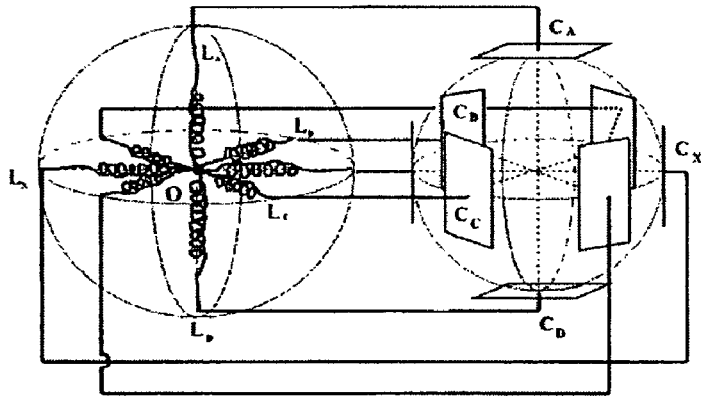
Fig.4. Spherical oscillating circuit for Lensky "X-polar" waves formation.

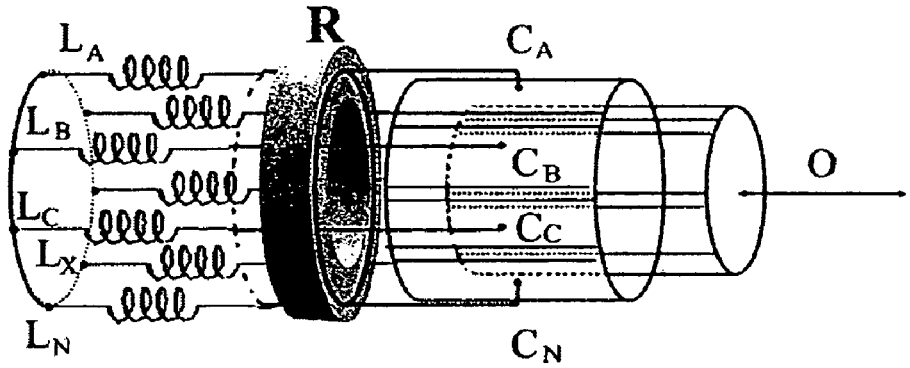
Fig.5. Cylindrical oscillating circuit for Lensky "X-polar" waves formation.
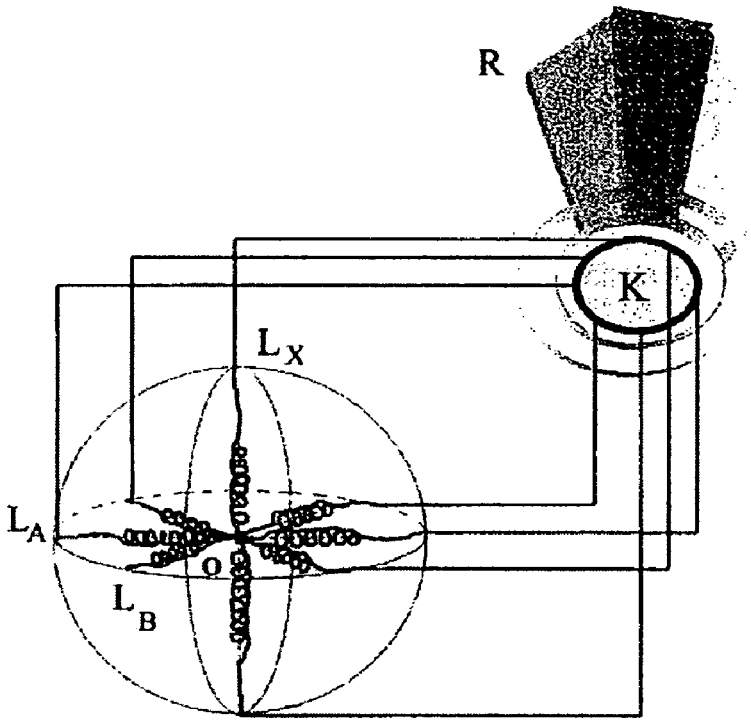
Fig. 6. Opening oscillating circuit for Lensky "X-polar" waves formation.

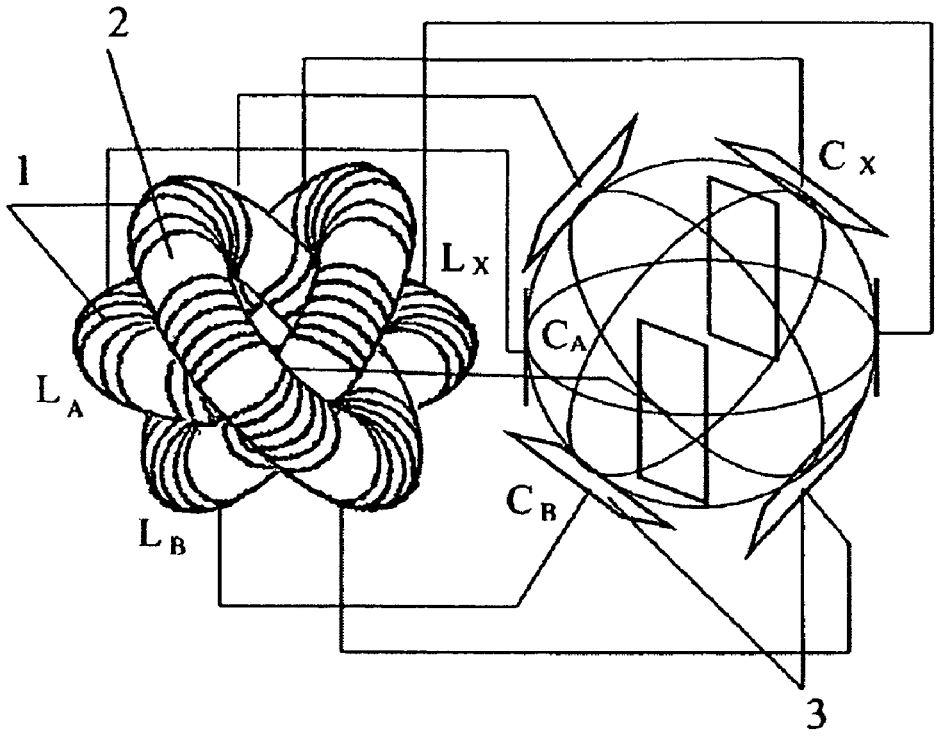
Fig.7. Oscillating circuit with torsion inductor and spherical capacitor.
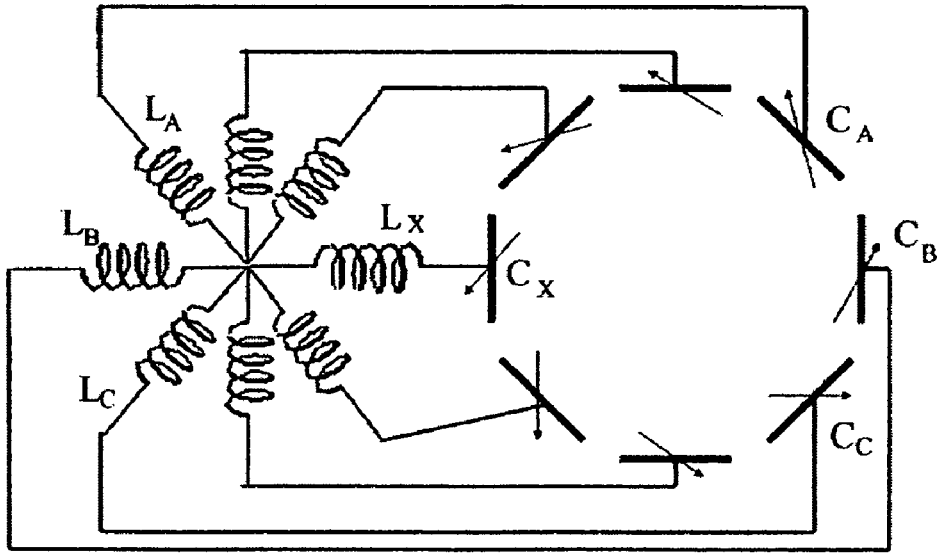
Fig.8. Diagram of "X-polar" oscillating circuit forming Lensky *volume waves* of any given number of polarities.

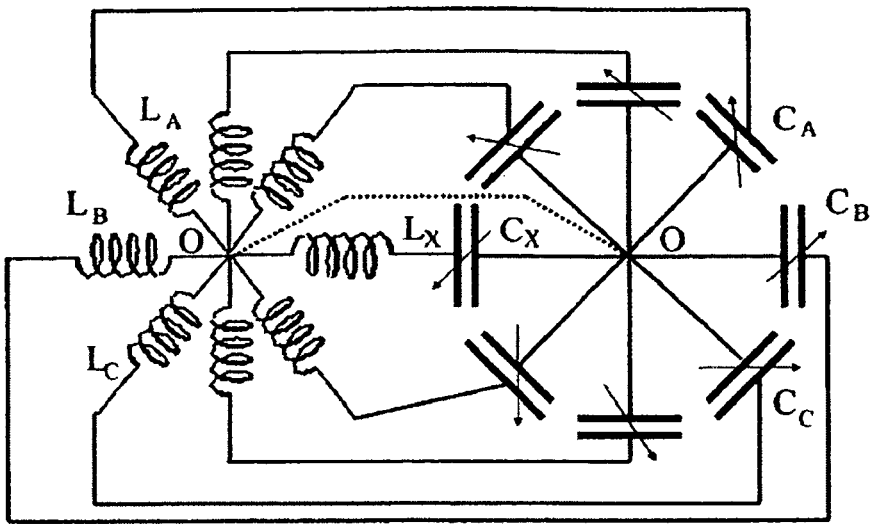
Fig.9. Diagram of "X-polar" oscillating circuit intended for formation of *screw* (line O-O is connected) and *pseudo-volume* (line is disconnected) waves.
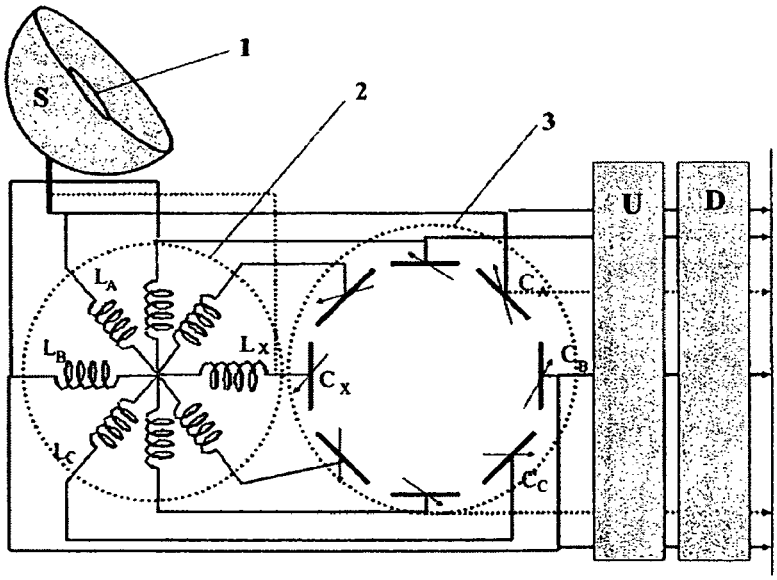
Fig.10. Tuning circuit with variable parameters.

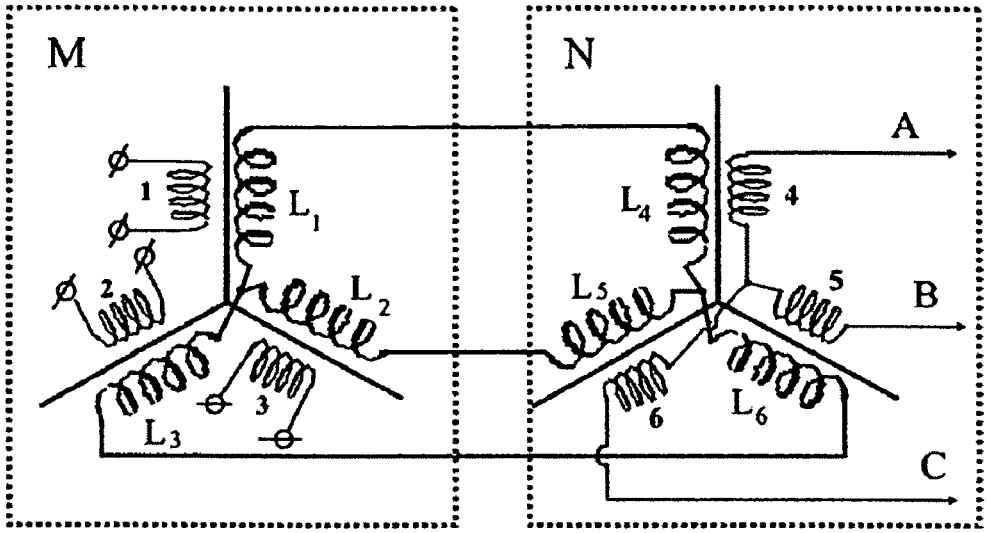
Fig. 11. Diagram of couplings between induction coils on departure from two-polarity and collecting of three-polar relations.
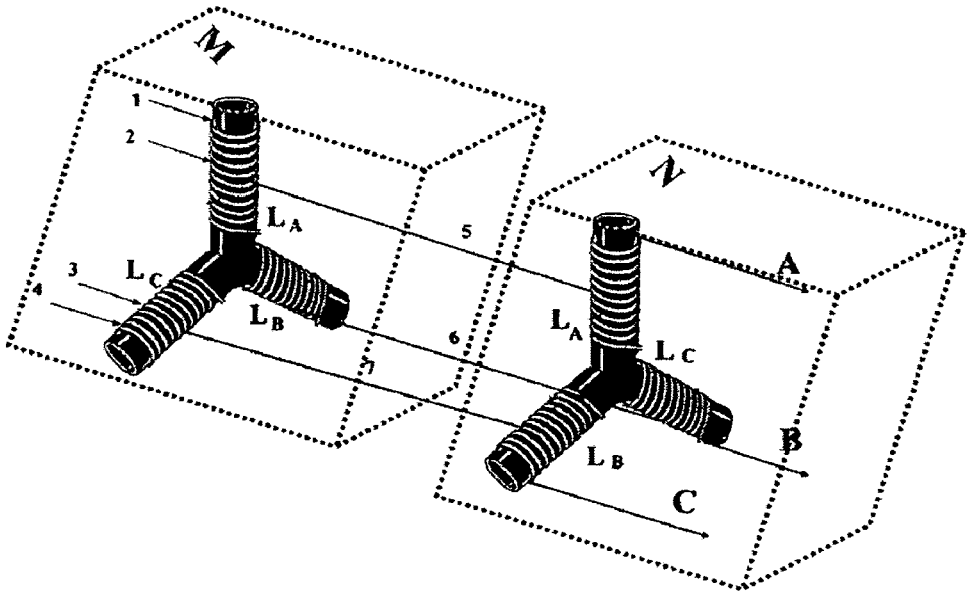
Fig.12. Constructive execution of cascades for forming and collecting of three-polar relations.

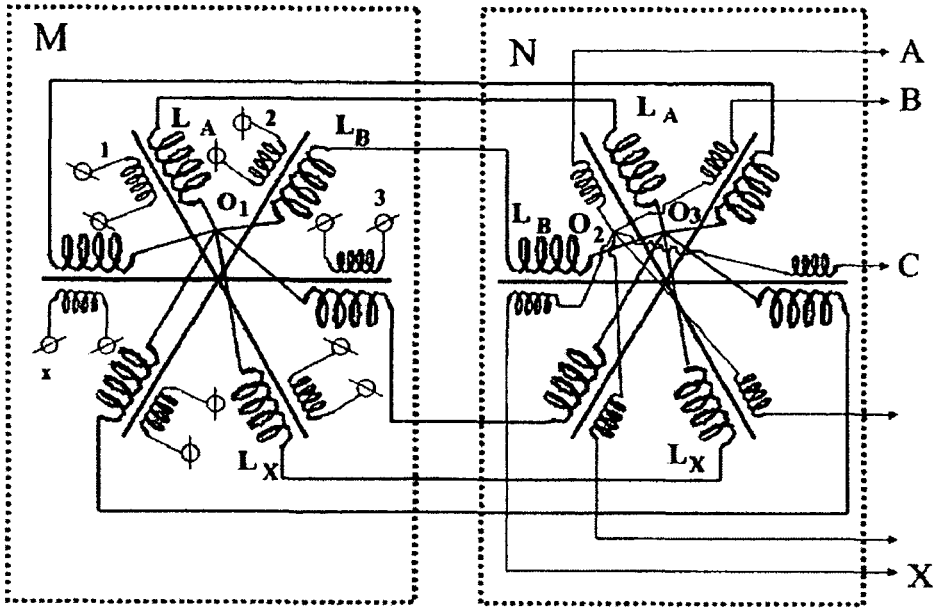
Fig. 13. Diagram of couplings between induction coils on departure from two-polarity and collection of "X-polar" relations.
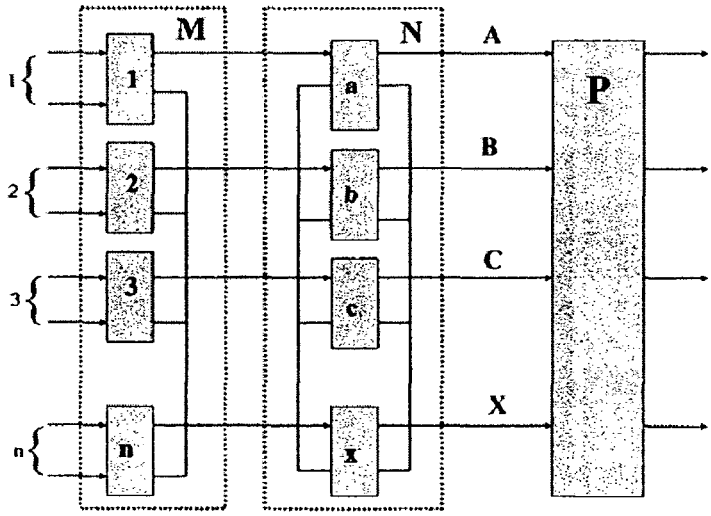
Fig.14. Diagram of transformation of two-polar processes into pseudo-multipolar.

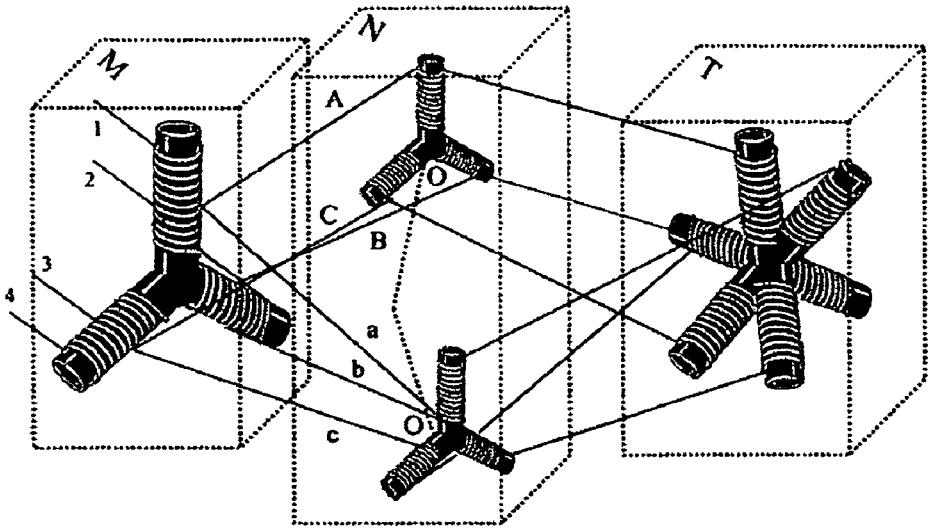
Fig.15. Diagram of six-polar relations formation.
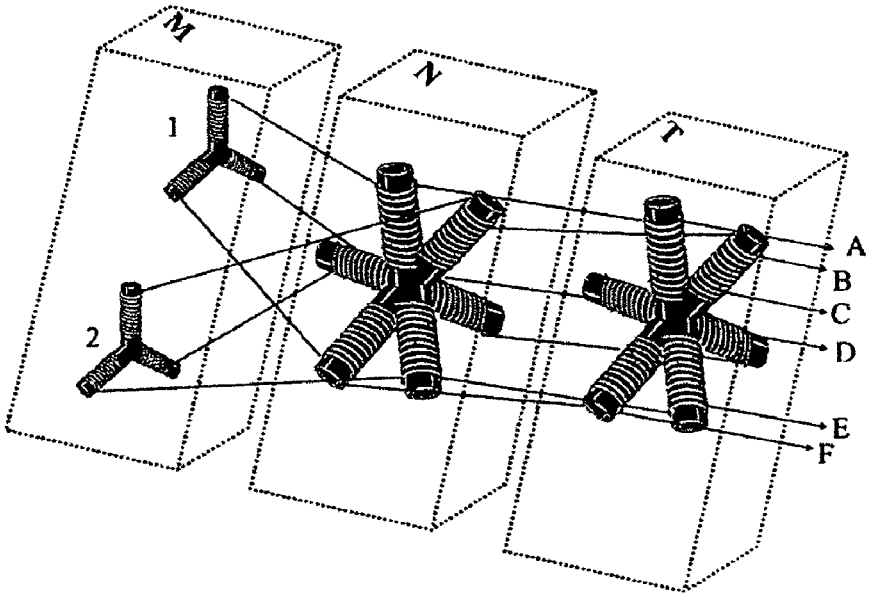
Fig.16. Six-polarity formation on the basis of two three-polar current supplies.

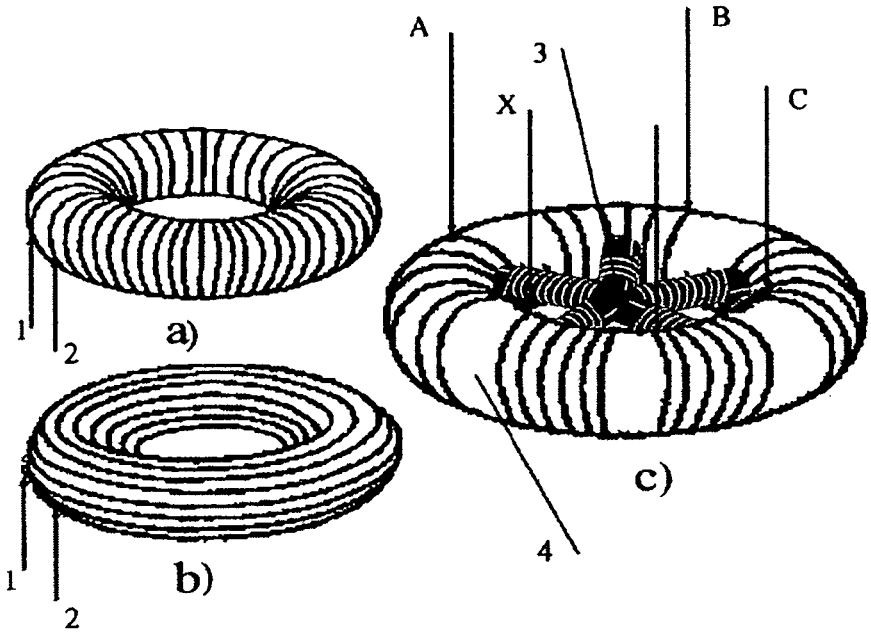
Fig.17. Comparison between two-polar relations in solenoid (b), of torsion type (a) and of multipolar type (c).
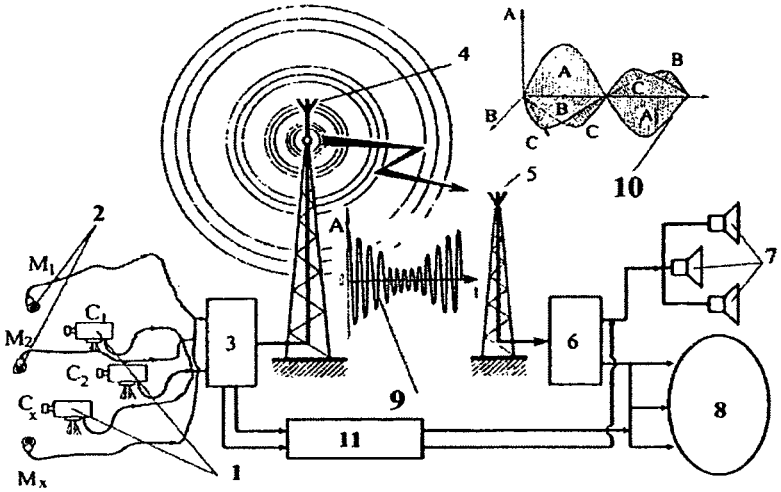
Fig.18. Diagram of multipolar or pseudo-multipolar signals and waves formation, transmission and reception for obtaining visual and acoustic volume phantoms. Example is given for three-polar waves.

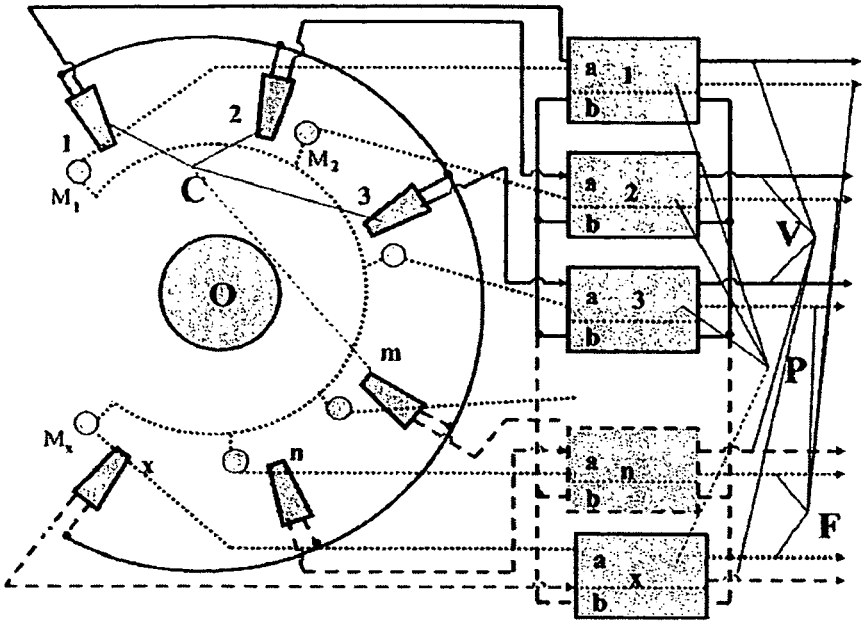
Fig.19. Diagram of formation of pseudo-volume and screw electrical signals of "X-polarity" for volume vision and acoustic phantoms.
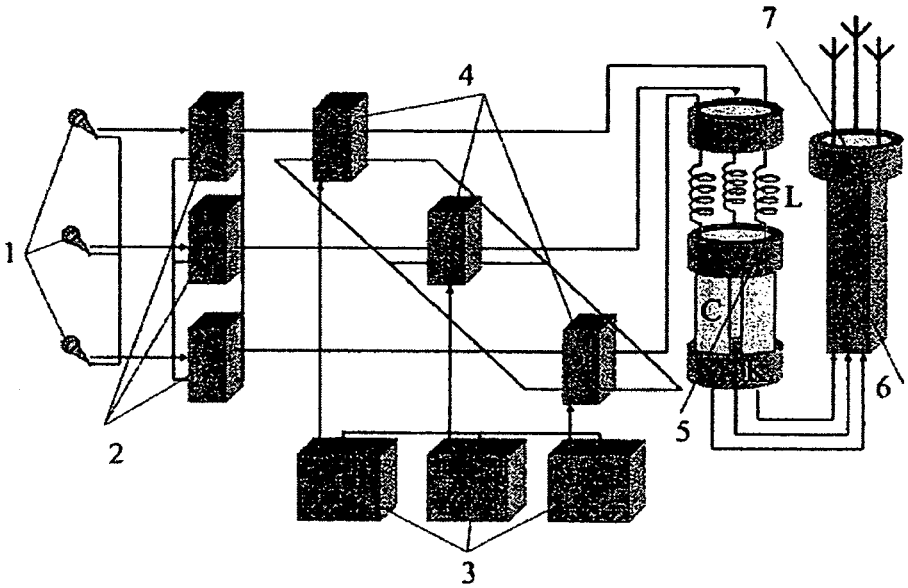
Fig.20. Diagram of three-polar radio-waves formation and transmission.

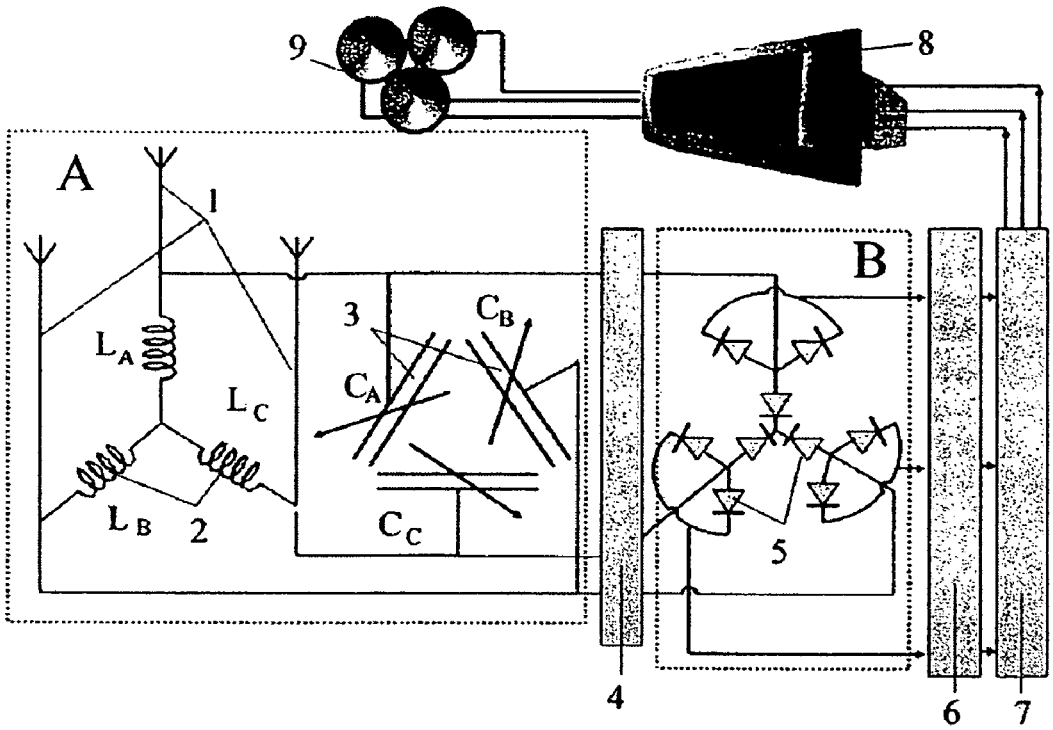
Fig.21. Diagram of reception and reproduction of acoustic and visual phantom of tree-polar wave.
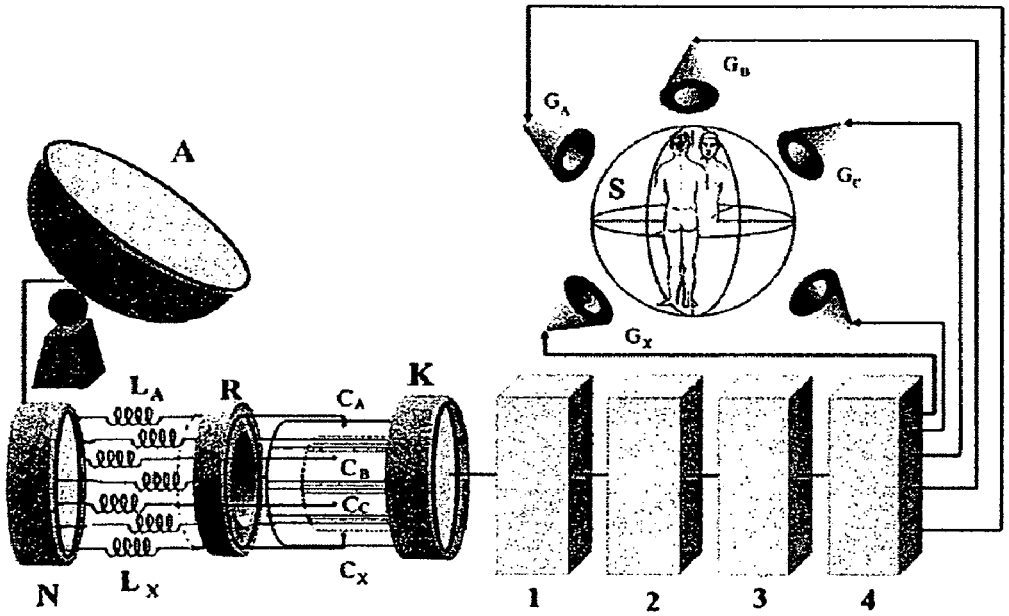
Fig.22. Diagram of volume vision phantom formation for X-polar transmission.

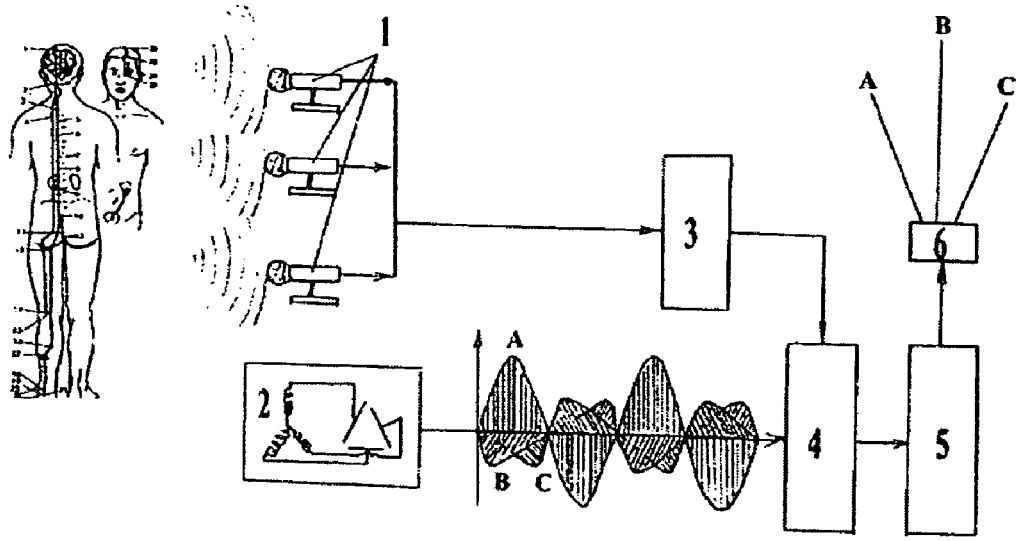
Fig.23. Image of human heart pulse formation on the three-polar wave.
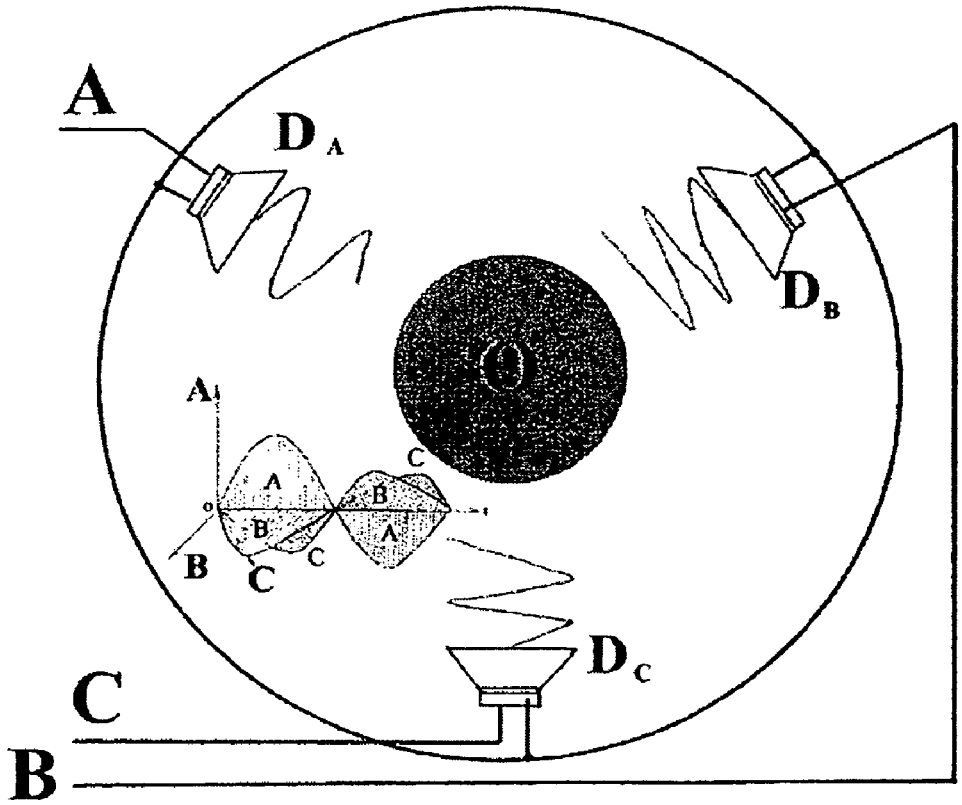
Fig.24. Formation of volume acoustic phantom.

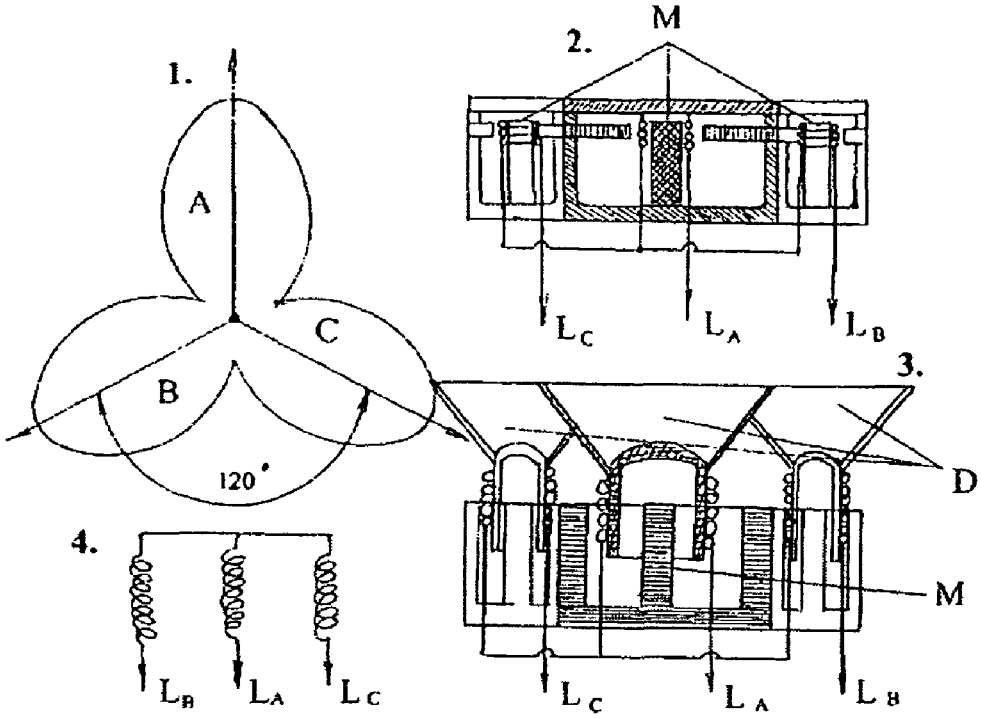
Fig.25. Construction of three-polar microphone (2) and loud-speaker (3).
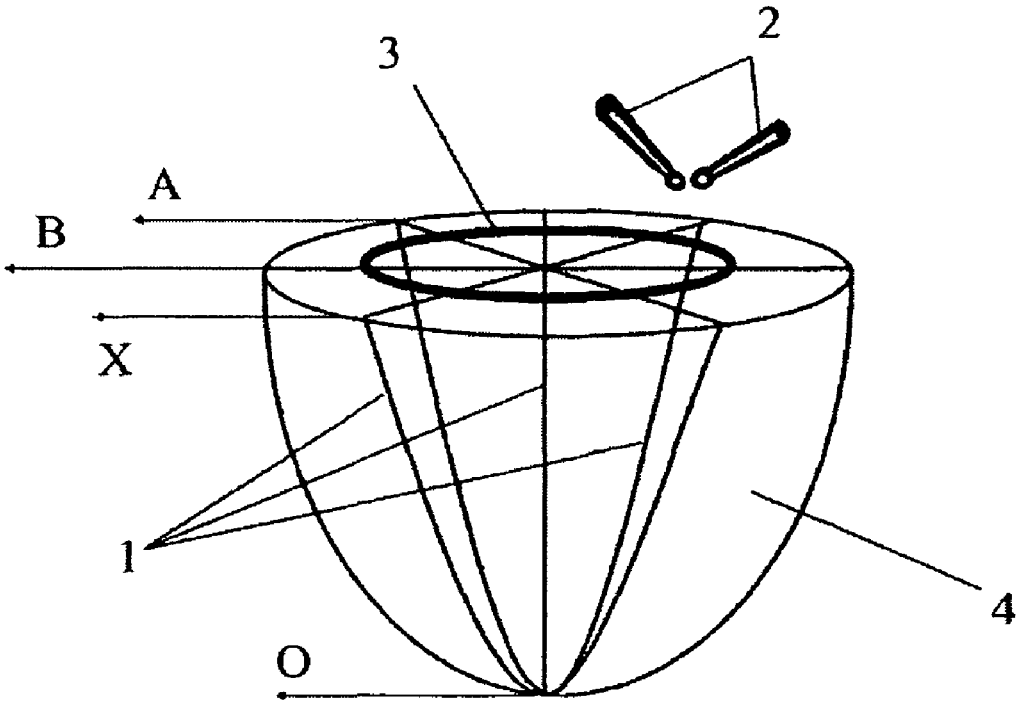
Fig.26 Multipolar musical instrument.

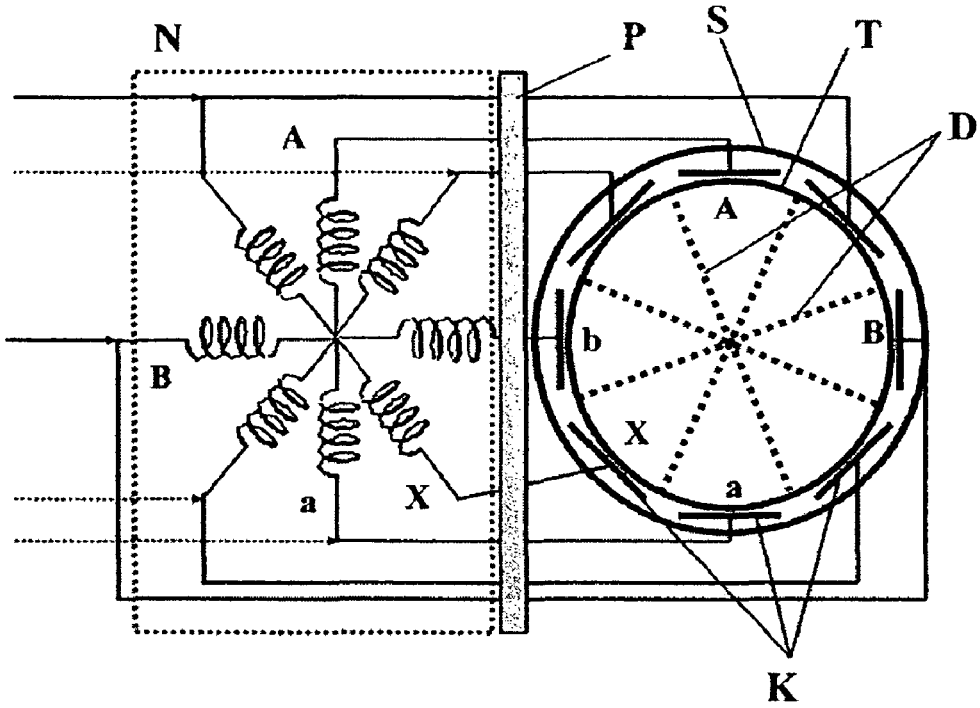
Fig.27. Diagram of structuring or polarization of mediums.
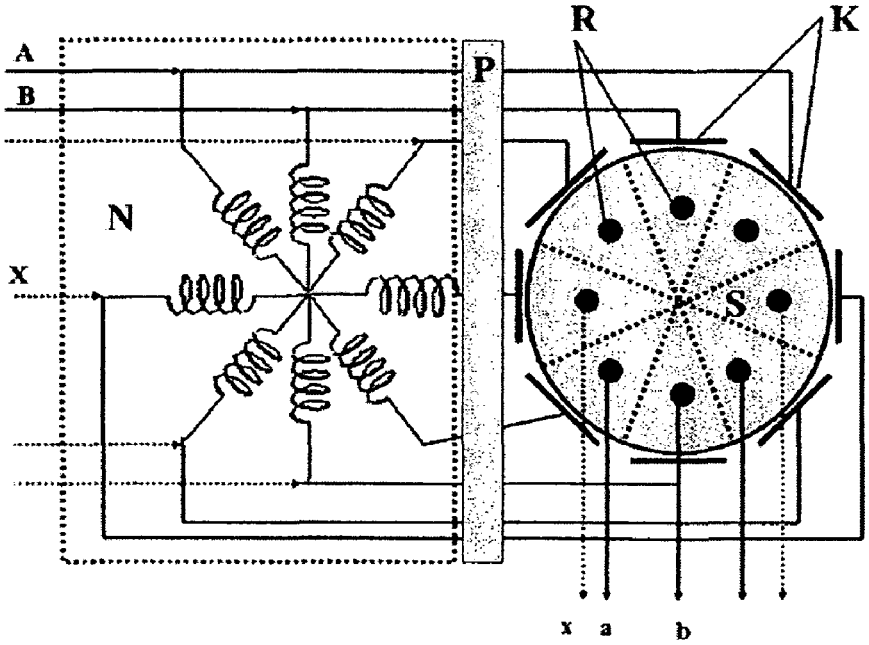
Fig.28. Transformation of polar and structural relations.

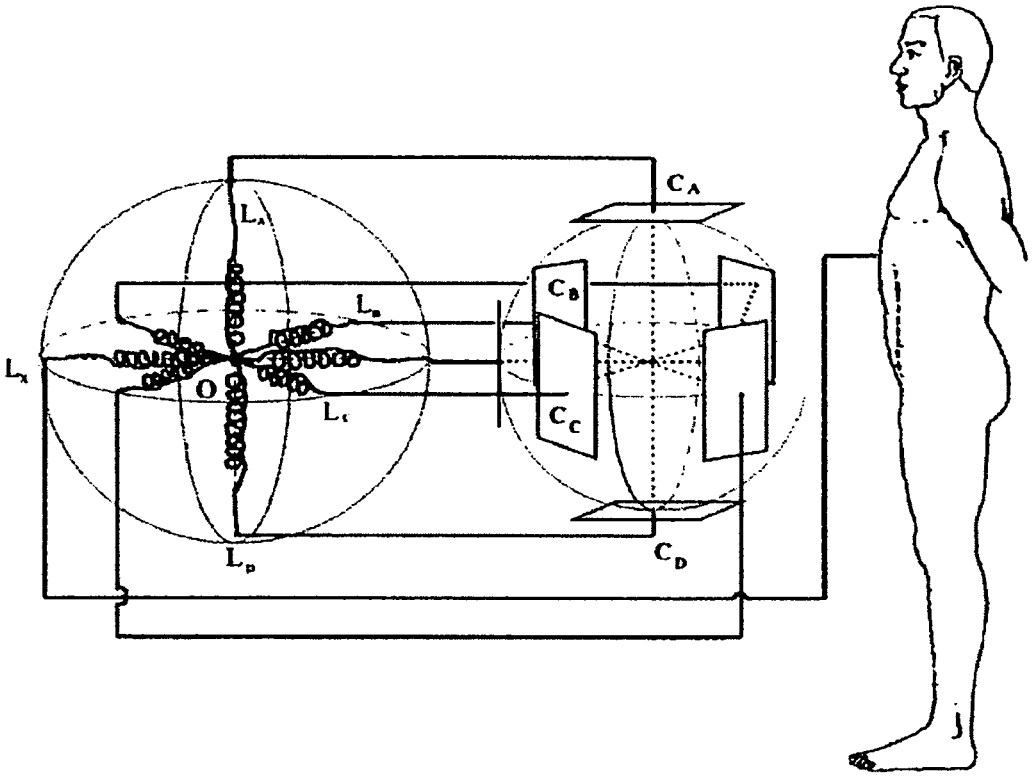
Fig.29. Determination of a phase (polar) condition of a biological object or objects of inanimate nature.
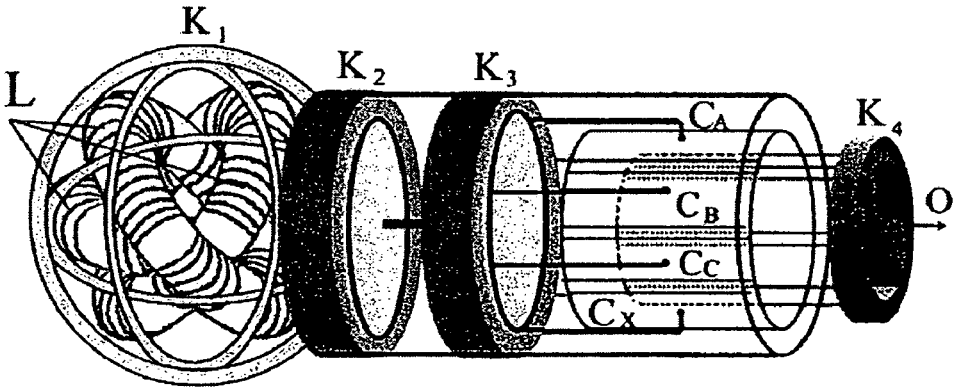
Fig.30. Diagram of a switching mosaic of polarities and their number in a multipolar circuit.

GENERATION OF MULTIPOLAR ELECTROMAGNETIC ENERGY

FIELD OF THE INVENTION

The present invention relates to methods, devices and systems for generating novel forms of electromagnetic energy.

BACKGROUND OF THE INVENTION

It is known that the worldwide spread or transmission of information by radio, television, telecommunications and the internet are based on electromagnetic processes. The basic elements in the devices (FIG. 1) conventionally employed for such purposes are capacitors, C, with bi plates, oscillating circuits, with a bi-polar relationship between the capacitor's bi plates, and the linear wire, L, of the induction coil. Electromagnetic waves generated under such conditions, therefore, have a bi-polar nature. Thus, the bi-polar oscillating circuit of FIG. 1 is the heart of all methods and means utilized in all conventional electromagnetic wave processes.

Based on discoveries of Faraday, Thomson, Feddersen and other scientists, James Clark Maxwell in 1864 published a theory, according to which electric and magnetic fields can diffuse in space with a terminal speed equal to the speed of light. With the bi-polar oscillating circuits as a basis, there are now available:

radio communications—information transmission by electromagnetic waves of radio-range;

radio-broadcasting—speech and music transmission by electromagnetic waves of radio range;

radio-location—location of objects due to reflection by them of the radio waves;

television—image, speech and music transmission by electromagnetic waves of the radio range;

internet—information transmission on the basis of bi-polar electromagnetic processes;

radiotelescopes—means of search in universe exploration.

Thus, all modern elements of radio-engineering, measuring instruments, devices and methods have been developed, based on this bi-polar type of electromagnetic radiation. All recent research and theoretical investigations are also based thereon.

It is further known that all basic electrical and magnetic processes, and devices meant for them, are built on the relation between the "positive" and "negative" charges in the system as well as on their exchange of frequencies positions.

Transformers, built on such solenoids where there are bi-polar couplings at the beginning and end of the linear wire are known. Under these conditions, according to the law of electromagnetic induction, a direct electromagnetic coupling takes place between the coil and the transformer core.

Three-phase alternative currents are known as well as generators and electrical motors where the two-polar electrical processes are displaced in time between three phases.

Capacitors with two plates are known.

Diodes and other elements of electronics intended for application in a line between positive and negative frequency-changeable potentials (currents) are known.

Microphones, transforming acoustic waves into electrical currents (signals) in a coil with linear wire are known.

Loudspeakers, transforming electrical currents into acoustic waves are known.

Amplifiers, and other devices, transforming the entering signal in accordance with their two-polar type are known.

A variety of instruments and devices that preserve the laws of the two-polar relations and spread out them by similarity are known.

A preservation of the two-polar induction law in physics so that all electromagnetic devices exist only according to the principle of this law preservation is known.

The application of the two-polar electromagnetic relations in physics so that, for example, in the accelerator of elementary particles only the two-polar means are employed for their acceleration, registration, and analyses is known.

The application of electrical currents, signals and waves in biology so that as a basis serves only the two-polar nature of electromagnetism is known. Devices for an influence on micro- and macro-biological objects with electromagnetic processes have been developed. For example, electrophoresis and diathermy in medicine; application of frequency processes for influence on microbes; watering plants with water treated with magnetic and electrical fields ("live" and "dead" water).

The application of two-polar means in electrochemistry and in processes of electrolysis is known.

Processes of investigation of anomalous phenomena on Earth and in Cosmos built with two-polar instruments of a wave nature as a basis are known.

Computers and means of information processing and storage based on the two-polar relation between "positive" and "negative" potentials and Boolean logic are known.

The common use of such electromagnetic means, which have only two-polar nature, in the processes of vital supplies procurement, is known.

With the two-polar electrical interrelations as a basis, there are now available:

generators and motors—devices, transforming electrical two-polar energy into mechanical movement; incandescent lamps and heaters—devices transforming electricity into light and heat; computers—devices, enhancing man's intellectual activity; radio and television—devices transforming transmitted two-polar electromagnetic signals into images of hearing and vision; electrochemistry—application of electrical principles to chemical processes of two-polar nature; high energies in accelerators—devices for application of two-polar objects called electrons, protons, etc. with a purpose of exploring the world that responds to two-polarity; two-polar electrical objects—particles detected by two-polar means and responding to two-polar relations and couplings (electrons, protons, positrons, etc); measuring and registering electrical apparatus, instruments—devices for detection of objects, responding to two-polar properties and relations.

The main disadvantage of existing devices and elements of application in electromagnetism is that they do not allow one to break away from the existing two-polar laws, but transmit them from element to element by induction. The ability of conventional devices to serve only two-polar principles eliminates the consideration of systems employing three and more plates in capacitors, three and more cores in inductivity, three and more relations in electrolysis, etc.

The disadvantage of information means intended for hearing and sight analyzers is that they are all built on the primordial basis—the two-polar relations in capacitor (two plates) and dual relation between the coil and capacitor (in oscillating circuits). This leads to the impossibility of achieving a volume visual image, due to the two-polar wave interference. Volume hearing sound is missing due to plane reflection of the two-polar electrical signals by the surface of loudspeaker diffusers.

The disadvantages of these two-polar bases and the conservation of laws of two-polar relations are present in all existing devices and equipment. Volume space implementation of the electromagnetic basis and of electromagnetic waves is excluded by modern technical designs, implemented to the components of electronics, radio-engineering, television. The principle of two-polarity is embedded into all known instruments, means of communications, television, location, exploration of anomalous phenomena on earth and the cosmos, etc.

For example, there are no instruments with capacitors that are three-polar or with a larger number of polarities; there are no oscillating circuits with coils that are three-polar or with a larger number of polarities.

The disadvantage of modern computers, as well as of means of information accumulation and processing, consists in their primitive two-polar basis, which makes research of multipolar processes (for example, interaction of several bodies in space or testing human phase conditions) complicated or altogether impossible.

A big disadvantage is in the fact that all information means are built only on one basis, i.e., two-polarity. This permits intruders to penetrate information channels or banks and to spy or change the information.

An enormous disadvantage of two-polar systems is that they only prove the existence of two-polarity and block the discovery of new fields of energy and information sources.

It is an object of the invention to provide methods and systems which rely on multipolar, i.e., greater than two-polar electromagnetic energy generation and transmission.

SUMMARY OF THE INVENTION

The above and other objects are realized by the present invention, one embodiment of which relates to a method of generating multipolar electromagnetic energy from bipolar electromagnetic energy, comprising supplying bipolar electromagnetic energy to plural cascades in a bipolar electromagnetic circuit such that at least a portion of the bipolar energy is converted into multipolar energy therein and separating the multipolar energy from other forms of energy produced by the circuit.

Another embodiment of the invention concerns a system for converting bipolar electromagnetic energy to multipolar electromagnetic energy comprising means for supplying bipolar electromagnetic energy to a first set of at least three induction coils ($L_1$, $L_2$, $L_3$ - - - $L_x$), wherein x=the number of coils, all of the induction coils being electrically connected via one end of each coil, the other end of each coil being electrically connected to an end of a corresponding induction coil in a second set ($L_{1a}$, $L_{2a}$, $L_{3a}$ - - - $L_x$) having the same number of coils as the first set and means for collecting from the other ends of the second set of induction coils, multipolar electromagnetic energy having a polarity equal to the number of coils in each of the sets.

BRIEF DESCRIPTION OF THE DRAWINGS

FIG. 1 depicts a two-polar oscillating circuit.

FIG. 2 depicts a three-polar Lensky oscillating circuit.

FIG. 3 depicts a graphic representation of Maxwell two-polar electromagnetic wave (a) and Lensky three-polar wave (b).

FIG. 4 depicts a spherical oscillating circuit for Lensky "X-polar" waves formation.

FIG. 5 depicts a cylindrical oscillating circuit for Lensky "X-polar" waves formation.

FIG. 6 depicts an opening oscillating circuit for Lensky "X-polar" waves formation.

FIG. 7 depicts an oscillating circuit with torsion inductor and spherical capacitor.

FIG. 8 depicts a diagram of "X-polar" oscillating circuit forming Lensky volume waves of any given number of polarities.

FIG. 9 depicts a diagram of "X-polar" oscillating circuit intended for formation of screw (line O-O is connected) and pseudo-volume (line is disconnected) waves.

FIG. 10 depicts a tuning circuit with variable parameters.

FIG. 11 depicts a diagram of couplings between induction coils on departure from two-polarity and collecting of three-polar relations.

FIG. 12 depicts a constructive execution of cascades for forming and collecting of three-polar relations.

FIG. 13 depicts a diagram of couplings between induction coils on departure from two-polarity and collection of "X-polar" relations.

FIG. 14 depicts a diagram of transformation of two-polar processes into pseudo-multipolar.

FIG. 15 depicts a diagram of six-polar relations formation.

FIG. 16 depicts six-polarity formation on the basis of two three-polar current supplies.

FIG. 17 depicts a comparison between two-polar relations in solenoid (b), of torsion type (a) and of multipolar type (c).

FIG. 18 depicts a diagram of multipolar or pseudo-multipolar signals and waves formation, transmission and reception for obtaining visual and acoustic volume phantoms. Example is given for three-polar waves.

FIG. 19 depicts a diagram of formation of pseudo-volume and screw electrical signals of "X-polarity" for volume vision and acoustic phantoms.

FIG. 20 depicts a diagram of three-polar radio-waves formation and transmission.

FIG. 21 depicts a diagram of reception and reproduction of acoustic and visual phantom of three-polar wave.

FIG. 22 depicts a diagram of volume vision phantom formation for X-polar transmission.

FIG. 23 depicts an image of human heart pulse formation on the three-polar wave.

FIG. 24 depicts a formation of volume acoustic phantom.

FIG. 25 depicts a construction of three-polar microphone (2) and loud-speaker (3).

FIG. 26 depicts a multipolar musical instrument.

FIG. 27 depicts a diagram of structuring or polarization of mediums.

FIG. 28 depicts a transformation of polar and structural relations.

FIG. 29 depicts a determination of a phase (polar) condition of a biological object or objects of inanimate nature.

FIG. 30 depicts a diagram of a switching mosaic of polarities and their number in a multipolar circuit.

DETAILED DESCRIPTION OF THE INVENTION

The present invention is predicated on the discovery of a method and system which enables a full disentanglement from the two-polar relations in wireless (wave) systems between transmission and reception. Two-polar electromagnetic current supplies, induction and capacitance of a spatial form are constructively used for separation from the two-polarity state. The form of transmitted wave depends on the geometric design of induction (L) and capacity (C).

Thus, the wave form can be changed employing the new type of oscillating circuits of the invention. The spatial waveform depends on the geometry of the inductor (L) and the geometry of the surfaces of the capacitor (C), placed in a system and having a number exceeding two. The laws of relations between the components of such waves in a packet are formally and mathematically developed in a monograph [Lensky, A. Kotchnev, "Fundamentals of Multipolarity", Irkutsk University Press, 192 p., 1986], the entire contents and disclosure of which are incorporated herein by reference. Hereafter volume waves are referred to as MULTIPOLAR. The waves of the spatial form which differ from the volume ones will be called PSEUDOMULTIPOLAR.

FIG. 2 depicts a schematic diagram of the oscillating circuit for three-polar relations between coils L (LA, LB, LC) and plates of a three-polar capacitor C (CA, CB, CC). The graphic image of the two-polar Maxwell wave and three-polar Lensky wave is shown in FIG. 3.

It has been experimentally determined that the existing modern reception devices "do not see" a multipolar wave. This means that even if the universe is filled with radio waves, but they have a non-two-polar basis, they will not be detected by existing instruments. To survey the universe with modern means is also not advisable for another reason: the two-polar devices are well-known for their low productivity. This manifests itself in the two-polar basis fast saturation. For example, modern radiotelephony, radio, television densely saturate the space with one type of electromagnetic carrier and create electromagnetic smog.

A volume of waves of different frequencies but containing a specific number of polar interrelations in each wave packet is hereafter termed a "loka". For example, all volumes of waves of the modern "ether", with their different frequencies ranges, belong to loka two. In the same way, all volumes of waves of different frequency ranges can belong to loka three, four, and five and so on. The "lokality" of a multipolar wave is determined by the number of waves which comprise its packet. Therefore, the first task of forming a multipolar wave formation, with the aim of disentanglement from the two-polarity, is solved by creating an oscillating circuit which has a given number of X-polarities.

The number of polarities in a wave depends on the form of induction L (FIG. 2-$L_A$, $L_B$, $L_C$ are denoted for 3-polar circuit) and of the plates of capacitor C (for three-polar circuit CA, CB, CC). In the design of the circuit of the invention, all spatial forms are employed. As an example, there are shown circuits diagrams of: three-polar prism-like (see FIG. 2); X-polar spherical (see FIG. 4); X-polar cylindrical (see FIG. 5); X-polar having shape of a ring of petals forming the "corolla of a flower" (see FIG. 6). An X-polar having a torsion inductor and spherical capacitor are shown in FIG. 7.

In every instance, inductors LA, LB, . . . Lx and capacitors CA, CB, . . . , Cx are variables and all spatial degrees of freedom are utilized. The "lokality" of a given polarization (for example, loka five) is increased, owing to the property of the oscillating circuit—to change frequency inside of this loka. For this purpose the oscillating circuit has variable parameters. With this aim the capacitor plates are displaced in relation to each other (FIG. 5) by rotation of collector R and by cylinders movement along axis 0.

To "set" a loka for modes of waves formation and reception, the oscillating circuit is designed so that by means of a switch (R at FIG. 5 and K at FIG. 6) the number of induction coils and capacitor plates, coupled with each other, are changed. In the variable oscillating circuit the spatial position and number of induction coils (1 at FIG. 7) depend on the constructive execution (2 at FIG. 7) of torsion inductions in relation to each other; spatial placing of the capacitor plates (3 at FIG. 7) correlates with induction.

Thus, there exists the possibility of a varied selection of oscillating circuit parameters:

1. according to polarities number (loka);
2. according to frequency ranges inside of loka of a given number of polarities;
3. according to parameters of each wave, forming the whole packet of the multipolar wave.

All design varieties of oscillating circuits can be briefly represented in a form of a schematic diagram (see FIG. 8). Here the purpose is to carry out a multipolar oscillating process for a subsequent modulation (on this "carrier") of multipolar volume waves and after that their reception for a subsequent detection (decoding) into multipolar signals. The number of coils LA, LB, . . . , Lx of multipolar induction as well as the number of plates CA, CB, . . . , CX of multipolar capacitor is set in accordance with the given task. Modern power-engineering, electronics, telephony, radio, television, location and radio telescopes do not have such instruments or elements. Laboratory research has shown that problems connected with information transmission by modern means can be successfully solved by multipolar waves and multipolar signals. Under these conditions there is an incalculable multitude of multipolar wave variations, thus, for example, making it impossible for malefactors to interfere with transmitted information.

Simultaneously, placed in a specialized system, the existing current supplies, sources of signals and waves, transmitting, receiving, recording, transforming devices as well as their elements, depart from the two-polarity and enter pseudo-multipolarity.

This means that the form of electrical signals, or electromagnetic waves formed in such systems, differ from the volume waves. Therefore, they will be referred to as pseudovolume and screw waves.

All forms of spatial constructions produced from the existing elements of electro and radio engineering, television and electronics which are intended for pseudo-volume and screw multipolar wave formation can be united in a schematic representation such as in FIG. 9. Here LA, LB, . . . , Lx are coils the number of which corresponds to the wave form set by the number of polarities; CA, CB, . . . , Cx, accordingly, are the number of capacitor plates. The diagram of "X-polar" oscillating circuit intended for the formation of screw (line 0-0 is connected) and pseudo-volume (line is disconnected) waves is shown in FIG. 9. In the diagram of "X-polar" oscillating circuit, intended for screw waves formation, the line 0-0 is connected, while for pseudo-volume waves the line 0-0 is disconnected. Thus, the formation of multipolar and pseudo-multipolar waves are realized on the first cascade—the wave generator.

In the second stage, in multipolar receivers or other collection places, there takes place a COLLECTING of loka of a given number of polarities, formed by electro-wave transition in the first stage. Antenna S (FIG. 10), regulated on reception polarity (1) and inductions 2 of variable connections number with coils LA, LB, . . . , Lx and capacitor (3) of variable capacity and connections number with plates CA, CB, . . . , Cx, transfer the received multipolar wave for amplifying in block U. If the wave is modulated, it is detected in block D. The amplifier and detector correspond to the multipolar wave of the tuning circuit (modern amplifiers and detectors are not suitable). Note that even modulated and demodulated waves have multipolar or pseudomultipolar form.

For pseudo-multipolar waves detection, instead of elements 2 and 3 which comprise receiving oscillating circuit, there is utilized an oscillating circuit made of the conventional elements of electronics, radio-engineering and television. In exactly the same way, for disengagement from the primordial two-polar current supplies (1, 2, 3 FIG. 11) in the electrical net, a minimum two cascades (M and N) are necessary. In the block M of the first cascade the coils of the inductivity L1, L2, L3 are placed in the system so that by one end they are tied and the other ends go to the block N of the second cascade. The energy transformation, realized in the coil system L1, L2, L3 of this block, still contains two-polar "mixtures" and is dependent on two-polarity. In order to collect three-polar relations, the inductions L1, L2, L3 are connected with inductions L4, L5, L6 of the block N. It is this block that represents the second cascade where transformation takes place that laws of loka 3 (three-polar) are fulfilled. The peculiarity of these laws is in the three-polar relations of this type:

$$A+B+C=0;\ A+B=C;\ A+C=B;\ B+C=A \quad (1).$$

This means that for any power parameters the relations (1) are fulfilled. Similar relations are not fulfilled in the two-polarity. Therefore, on the second cascade (block N) a complete break away from the two-polarity, through collection, takes place. Constructively, it's better to execute cascades from the opposite directions (FIG. 12), even in a case of torsion inductions (see FIG. 7) because on the first cascade there should be formed not only electrical, but also magnetic waves. The variable signal (1, 2, 3) served on cascade M carries in induction coils two-polar properties which are transferred to the magnetic current. Therefore, inductions LA, LB, LC contain a mixture of the two-polar properties. However, on the second cascade N only three-polar relations are formed. Therefore the signals have pseudo-multipolar properties.

The diagram of the X-polar relations collection, given in FIG. 13, shows that the number X is set according to the tasks, but the principle in every loka of polar relations remains the same. The point of departure are the two-polar current supplies 1, 2, 3, . . . , x. Transformation takes place through magnetic coupling and the coupling of inductivity coils LA, LB, . . . , LX in one node 01 (see block M). The same result can be obtained with a system of capacitors CA, CB, . . . , CX as well as with a complex system, consisting of inductions LA, LB, . . . , LX and capacities CA, CB, . . . , CX. Thus, the concept of "ground", becomes relative. A common node of couplings of a given number of coils serves as a "ground". For example, in block N we see two "grounds", 02 and 03. A common ground should not be made, because, then, we would get not X-polar relations but a set of two-polar relations. Collecting, executed in the block N (second cascade), causes the pseudomultipolar relations to fulfill laws:

$$Aa+Bb+Cc+\ldots+Xx=0 \quad (2)$$

where A, B, C, . . . , X=types of polarities; a, b, c, . . . , x=integers.

The use of an additional cascade completely separates the power-engineering relations from the two-polar ones. If more cascades are used, then the "ground" between the second and subsequent cascades can be made common. Under these conditions pseudo-multipolar and screw signals (currents) are formed, but they already have a multipolar basis. The relations between a set number of X-polarity in a loka have been developed [Lensky, A. Kotchnev, "Fundamentals of Multipolarity", Irkutsk University Press, 192 p., 1986]. Thus, employing two cascades, it is possible to make a transition to any loka of pseudo-multipolar and screw signals. Note especially that every loka of the same polarity has only its own relations laws. This means that 1) modern devices, means of registration and detection "DO NOT SEE" processes in lokas with polarities numbers above 2; 2) every loka has only its own relations laws and, consequently, differing quantitative parameters; 3) means and elements for one loka are not suitable for other lokas.

The elements of modern radio-engineering, electronics, television, communications, location and radiotelescopy as well as specialized devices (amplifiers, microphones, loudspeakers, television cameras, etc.) can be employed for obtaining pseudo-multipolar and screw signals (currents). In spite of the fact that all known varieties of devices have a two-polar basis, placed in a system, they can be transformed into sources of pseudo-multipolarity, if the collecting condition is fulfilled. Schematically, this is shown in FIG. 14. To achieve the transformation, it is sufficient to have two cascades in order that the law is fulfilled:

$$A+B+C+\ldots X=0,$$

where A, B, C, . . . , X=polarities (not to be confused with quantities) at the block N exit. Under these conditions each polarity is the result of interactions of all other polarities:

$$A=B+C+\ldots+X;\ B=A+C+\ldots+X;\ X=A+B+\ldots+N \quad (3).$$

If the "ground" on the secondary winding of the elements (1, 2, . . . , n) of the first cascade M and of the second (a, b, c, . . . , x) is made common, then the signals will have a screw form. The quantitative parameters of the polarities A, B, C, . . . , X is set according to the desired task employing the invention. According to diagram 14, elements (diodes, coils, capacitors, etc.) and also devices (amplifiers, television camera, microphones, etc.) can be grouped. However, this principle of cascade joining also applies to a bigger number of inlet sources (polarities). Block N (FIG. 14) of the second cascade itself can be taken as the first cascade. Of the collecting blocks, such as N, there can be several (N1, N2, . . . , Nx). Such collecting blocks are grouped into a desired system. In addition, blocks of different polarities may be grouped in systems as well.

It is possible, for example, to take as primal cascades five-, seven-, twenty in order to obtain on every second cascade correspondingly five-, seven-, twenty-polar couplings. After the "ground" of the second cascade becomes common (the second nodes of coils are bound in a common node), a system of complex lokas is formed. Taking into consideration the variety of collecting blocks and diversity of grouping variants of the second cascades with a different number of polar intercouplings, the number of possible forms of pseudo-multipolar signals becomes very large.

The practical significance of the pseudo-multipolar relations depends on the application field. For example, if as a basis we take two three-polar couplings systems (FIG. 15) with inductions A, B, C and a, b, c on the second cascade N, then connect them according to a principle of "mirror reflection" (i.e. in one of the systems on the second cascade positions of the beginning and end of the coils are exchanged for opposite), then with the "ground" (line 0-0 at FIG. 15) of the second cascades connected, a complex loka six (cascade T) is formed with the following relations laws:

$A+B+C=0;\ a+b+c=0;$ (*a, b, c*—polarities of the second system);

$$A+a=0;\ B+b=0;\ C+c=O.$$

In other words, we have laws of the relation of colors for sight analyzers, if A is an image of red, B—of blue, C—of green, a—sky blue, b—yellow, c—purple, there can be different types of interrelations in lokas with the same number of polarities. For example, six-polarity can be formed with three two-polar sources as well as with two three-polar ones (1, 2 in FIG. 16). Having passed cascades M, N, a six-polarity A, B, C, D, E, F is collected on cascade T. The difference between lokas with the same number of polarities is expressed in the laws of interactions between polarities.

The elements of multipolar devices have a constructive distinction in the execution of inductions, capacitors, diodes, etc. For example, induction coils (FIG. 17) can be utilized in a capacity of solenoid (b) or have an earmarking for torsion (a) fields (currents). Both in the first case (a) and in the second (b) the relations form remains two-polar, though the direction of magnetic currents of the torsion type (a) and of solenoid (b) differs. The multipolar induction (c) and multipolar torsion processes differ in principle and in their properties from the existing inductions and torsion processes. For comparison purposes, conceive of a continuous sounding and one broken into discrete sounds. The latter is a source of a variety of melodies. An indispensable condition is the inductions coupling (and of magnetic wire). Coming from preceding cascades, currents A, B, C, . . . , X (see FIG. 16) form a spatial type of signals (waves) and of magnetic currents. The examples of FIGS. 7 and 17 demonstrate that the schematic representation of inductions at FIGS. 8, 9, 11, 13 should not be interpreted as constructions. The same is valid regarding capacities and other elements of radio-engineering, electronics, television. Any spatial configurations are included in the relations laws between polar conditions of one or another loka.

In the process of theoretical and experimental research, the invention proves that all components of a given loka (multipolar wave packet) are inter-coupled both qualitatively and quantitatively. This means, for example, that a wave, formed by an oscillating circuit, is self-regulated so that if one or several of its components change, the remaining components also automatically change their parameters. For example, if in a three-polar wave (see FIG. 3*b*) parameters of a constituent A are changed by changing induction LA or capacitance CA (see FIG. 2), then parameters of constituents B and C of the wave also automatically change. Under these conditions, a relation XA+YB+ZC=0 or S (where X, Y, Z, S are some numbers) will be constantly fulfilled. In other words, the sum of the components constituents of the X-polar wave or of a multipolar signal is every time equal to zero (or some constant number). This self-regulation principle makes it possible to control all components of X-polar waves by means of one or a few of its components. The self-regulation principle is executed in any electrical, electromagnetic and wave form. It makes it possible to transmit a general picture by its components without the risk of wave interference.

For example, to obtain a transmittable acoustic volume phantom, it is sufficient to arrange loudspeakers in a space: a volume expression of a heart pulse about the human body is collected and transmitted (by means of oscillating waves) with a subsequent reproduction of the acoustic volume "body," corresponding to the cardio-vascular system of this person. As a result, we will have a phantom of the human cardio-vascular system, but every constituent of the transmitted volume wave is not an independent representation of this phantom. The diversity of multipolar and pseudo-multipolar forms of the invention permits one to implement a volume color television create volume phantoms for hearing, obtain biological forms of energy-information relations, create and modify structures (for example, increase fuel octane number), explore anomalies of the earth, carry out searches in the cosmos, solve matters of macro power-engineering and of microsystems (for example, the relations cited in the description of the six-polarity, correspond to the laws of the quantum chromodynamics and they are executed specifically on the electromagnetism basis).

EXAMPLE 1

Means of Communications, Television and Location.

The multipolar and pseudo-multipolar wave processes of the invention allow the formation, transmission and reproduction of volume phantoms for visual and acoustic perception. With this aim, microphones, either multipolar or traditional modern, as well as video cameras are arranged in space (FIG. 18), (1), (2) in the example for three-polar transmissions. The sound waves and visual images are transformed at this stage into electrical multipolar or pseudo-multipolar signals by transformer (3). In the transformer 3 signals are amplified and modulated, but already in multipolar or pseudo-multipolar form. Then they are transmitted as signals via cable to aerial 4, or to decoding device 11.

Receiving aerial 5 should correspond to the wave type, as also should detectors 6 and the decoders. Loudspeakers 7 and reproducing visual image device 8 should also correspond to the new formed signals.

At FIG. 18 are shown distinguished attributes that differ from today's television and broadcasting (for example, the two-polar Maxwell waves 9 and the three-polar oscillating waves 10). If the existing two-polar microphones, video camera, low-frequency amplifiers are employed, they are placed into a specialized system, as shown at FIG. 19. Video cameras C (1,2, . . . , x) are placed into a system (see description of FIG. 14).

In exactly the same way microphones (M1, M2, Mx) are grouped into a system near the stage O. The second ends of the electrical circuit of every source (produced by television tubes C (1, 2, 3, x) or by film cameras) and of electrical image of the sound signal (produced by microphones M1, M2, . . . , Mx or by other sound sources) enter amplification system (P at FIG. 19). Amplifiers of video (a in blocks P) and audio (b in blocks P) transfer video signals V and electrical audio F signals to the system forming a multipolar signal. For example, for video and audio recording it is a multi-track tape recorder, and for distance transmission, a modulating block.

An example of sound transformation into three-polar electrical signals and of subsequent forming of three-polar waves is shown in FIG. 20. An electrical signal is transferred from microphones (1) into low-frequency amplifiers (2). Generators of carrier-frequencies (3) are also placed into the system. Modulation is carried out in system 4, while three-polar wave formation in oscillating circuit 5, where the frequency is set by variables L and C by means of collector K. Amplifier 6 of high-frequency modulated waves and aerial 7 lead waves into the "ether". The formation of waves of high polarity numbers is carried out according to the same principle.

The reception of multipolar and pseudo-multipolar waves is carried out as shown in the example of FIG. 21. Tuning to the three-polar wave is carried out by aerial 1 and by system 2 of inductions. In the tuning block A multipolar elements (for volume waves) are employed or inductions LA, LB, LC and capacities CA, CB, CC of capacitors 3 (for pseudo-volume and screw waves) existing in modern radio-engineering. From the tuning block A the modulated wave enters amplifier block 4, then detection (decoding) block B. Detection in the block B is executed either by multipolarity elements (for volume waves) or by existing diodes 5 (for pseudo-volume and screw waves). In block 6 there is carried out filtration and in block 7, transformation. Under these conditions, the acoustic and visual phantoms are reproduced as a visual image in block 8 and in sound, in loudspeakers 9.

A diagram for X-polar wave reception and reproduction is shown in FIG. 22.

Here, the received multipolar wave (pseudo-multipolar) is transferred by aerial A to the tuning block N, where the tuning is carried out by inductions LA, LB, . . . , LX and by capacities CA, CB, CX through collectors R and K. These collectors change the number of polarities (loka) and the tuning frequency. Further, the wave is amplified in block 1, demodulated (decoded) in block 2, filtered in block 3 and is subjected in block 4 to such a frequency mode that by means of radiators GA, GB, . . . Gx it ionizes gas in a retort S. The phantom visually represents the original scene.

By analogy an acoustic phantom may also be reconstructed. For example, heart pulse, collected from a human being by microphones 1 (FIG. 23) is modulated in block 4 to a multipolar carrier frequency, generated in block 2, Amplified multipolar wave A, B, C in block 5 is transferred to aerial of block 6. The reproducible electrical signals A, B, C (FIG. 24) reconstruct in loudspeakers DA, DB, DC (in focus 0) an acoustic phantom of the human cardio-vascular system.

Acoustic phantoms can be visual, if the received wave is transformed as shown in FIG. 22.

EXAMPLE 2

Exploration of Cosmos and of Anomalous Phenomena.

In cases of search, e.g., exploration of the cosmos and of anomalous processes on earth variations of multipolar reception tuning may be employed. For detection, an oscillating circuit is employed that permits one to change:

a) loka, i.e. the number of polarities in the circuit being tuned;

b) tuning frequency in a given loka;

c) aerial, corresponding to the tuning loka.

An example of detection is shown in FIG. 10. The detected wave may have both acoustic and visual phantom properties. Therefore, it is fed to loudspeakers (see FIG. 24) and to volume vision (see FIG. 22).

EXAMPLE 3

Registration Devices.

Detection devices are, in fact, transformed into registration devices. For example, if, in a given oscillating circuit (e.g., twelve-polar) one shoulder (of induction and capacity) is left available, then an object, functioning in the same polar relation (loka) will bring the oscillating circuit in resonance. For this application, particularly suitable complex or biological objects (human beings), may be tested for their phase (polar) conditions.

EXAMPLE 4

Transformation Devices.

Modern devices represented by microphones, loudspeakers, tape recorders, film cameras, televisions are not suitable for transformation of multipolar signals into acoustic and visual ones. The existing devices for transformation of electrical signals into sound and image can be employed only for reproduction of pseudopolar and screw signals after placing them into a specialized system. FIG. 25 shows a model of a three-polar microphone and loudspeaker. As an example, there is shown a construction of three-polar microphone (2) and loud speaker (3) which have inductions LA, LB, LC placed on their common magnet M. These coils (A, B, C) are located under 120 degrees angle. Therefore, diffuser D of the loud-speaker 3 and microphone have form 1. The diagram of the coil coupling (4) has a common point which corresponds to the common principle given in FIG. 20. Such a constructive coupling of the coils and their configuration are applied to four, five, etc. number of polar relations; particularly for application to string instruments (FIG. 26). If one strikes strings (1) with a hammer (2), at the same time changing the strings length with the aid of device 3, then the multipolar instrument 4 utters such a sounding when proceeding into space the wave is of the same type as oscillating waves. For distance transmission, strings (1) are coupled with wires, and signals A, B, . . . , X are transferred to transformer which forms a multipolar electrical signal. The electrical signal is amplified and transferred to multipolar loudspeakers or enters an oscillating circuit. The described principle applies to any other constructions of instruments (string, percussion, bow, wind).

EXAMPLE 5

Forming of Structure

The polarization of water is executed by two-polar electricity. Also known are the magnetic structuring of liquid media. The multipolarity and pseudo-multipolarity systems of the invention widens the possibilities of polarization and the potential for structuring liquid and solid mediums. Obtained on the second (third, etc.) cascade N, the multipolar signals (FIG. 27) enter block P for amplification or transformation (of current, voltage) and are transferred to electrodes A, a, B, b, . . . , X. The medium is either isolated from direct influence (space T) or electrodes K are placed therein (space S). For medium polarization spaces S and T are divided by diaphragm D. Medium structuring does not require a diaphragm. Polarization differentiates medium properties; structuring modifies properties. Chosen parameters of the medium can be either increased or decreased by structuring (for example increase fuel octane number, thicken or thin colloid (for example, oil) or reduce the danger of explosives. The energizing of media may also be carried out by multipolar (pseudo-multipolar) waves.

EXAMPLE 6

Properties Transfer

The properties obtained after medium polarization can be transferred by waves or by electrical signals. However, multi polarity allows one to not only polarize a medium but also to transfer specific characteristics obtained in the polarization process over any distance by means of multipolar waves. For example, multipolar signals A, B, X (FIG. 28), fed to the second (third, fourth, etc.) cascade N are transformed for medium polarization in block P and transferred to electrodes K. The medium S is polarized according to its relations with the given type of multipolarity. Electrodes a, b, . . . , x collect the polarization of the medium and transfer it in a form of electrical signals (currents) for the realization of this characteristic. When the polarized electrical signals are fed to the oscillating circuit tuned in resonance therewith (FIG. 8 and FIG. 9), the obtained multipolar wave spread is then transferred to the location of reception or implementation.

EXAMPLE 7

Influence on Time Factor.

Experimentally, it has been discovered that biological species actively respond to multipolar and pseudo-multipolar electrical signals and waves. Active responses have been observed in treated (polarized) media (for example, water and soil). This response is expressed in the acceleration or slowing of vital activities and breeding processes. Thus, the biological life span becomes relative. The relative existence during life and reproduction of plants and biological species is determined by the selection of loka (number of polar relations) and also by the frequencies of wave or electrical signals (currents). Multipolar signals (currents) give rise to magnetic properties which also exert a regulating influence. For example, if micro-organisms are placed into a medium, polarized on loka 6 (six-polar), and then this medium is subordinated to the laws of light; in six-polarity, these laws reflect the above properties of color relations. If we denote polarities R—red, G—green, B—blue, then the six-polarity is fulfilled: R+G+B=V, where V is "white color"; R+G=b; R+B=g; G+B=r, where b—yellow; R—sky blue; g—purple. Under these conditions R+r=y; G+g=y; B+b=y. Microorganisms accelerate their reproduction processes 500-600%, while pathogens perish. Plants can be watered with polarized water or placed in a multipolar wave space.

For example, plants, placed in the acoustic space of the cardio-vascular human phantom (FIG. 24), intensely accelerate growth.

EXAMPLE 8

Testing of Polaris a Tion Type of Biological Objects and of Inanimate Nature If as one of the capacitor plates (or induction coil) a biological object (in FIG. 29, a human being) or an object of inanimate nature is used, this object turns out to be one of the parts of the total loka complex. Each polar condition in a multipolar packet is not independent but is part of the formation of other remaining polarities. Therefore, resonance condition in oscillating circuit determines a) lokality, to which object belongs and b) polar condition (phase) of this object. In the same way an object's polar condition can be detected by its response to the complex of multipolar signals (currents).

EXAMPLE 9

Computing Engineering and Programming

It's known that all modern computers are based on two-polar electrical relations. For this reason, computer programming depends on two-polarity systems. Multipolar and pseudomultipolar electrical signals may be used as the basis of computers (processors, communications network, elements of induction and capacity, microcircuits, etc); thereby enabling the implementation of the relations described for lokas of different polarity.

EXAMPLE 10

Methods and Means of Coding

The invention also enables the art of coding and decoding to avoid the major disadvantage inherent in existing two-polarity systems, i.e., two-digit coding. The implementation of multipolar and pseudo-multipolar systems, e.g., oscillating circuit collectors K1, K2, K3, enables the selection of any number of polarities, i.e. any loka. In addition, the collectors may be used to alter oscillation frequency. The blocks themselves (oscillating circuits), such as those in FIG. 30, can be placed into a couplings system such as the one shown in FIGS. 14 and 20. Such connections give rise to a variety of complex tokas which make the wave or electrical signals uncertain.

It will be evident to those skilled in the art that the methods and systems of the invention may be utilized in a wide variety of applications.

The invention claimed is:

1. A method of generating multipolar electromagnetic energy from bipolar electromagnetic energy, comprising: supplying bipolar electromagnetic energy to plural cascades in a bipolar electromagnetic circuit such that at least a portion of said bipolar energy is converted into multipolar energy therein; and separating said multipolar energy from other forms of energy produced by said circuit.

2. The method of claim 1 wherein said plural cascades comprise cascades, i=2, 3, . . . , n wherein n=the number of cascades, each cascade comprising a set of at least three identical bipolar electrical devices ($A_i$, $B_1$, $C_i$, . . . $X_i$;), each device having two bipolar inputs ($A_{i1}$, $B_{i1}$, $C_{i1}$, . . . , $X_{i1}$, and $A_{i2}$, $B_{i2}$, $C_{i2}$, . . . , $X_{i2}$) and two bipolar outputs ($a_{i1}$, $b_{i1}$, . . . , $x_{i1}$ and $a_{i2}$, $b_{i2}$, $c_{i2}$, . . . , $x_{i2}$), wherein the inputs of the first cascade are synchronously AC powered and each of said outputs, $a_{i1}$, $b_{i1}$, . . . , $x_{i1}$ and $a_{i2}$, $b_{i2}$, $c_{i2}$, . . . , $x_{i2}$ are electrically connected to corresponding inputs $A_{i1}$, $B_{i1}$, $C_{i1}$, . . . , $X_{i1}$, and $A_{i2}$, $B_{i2}$, $C_{i2}$, . . . , $X_{i2}$ of a device in the next cascade, each of said electrical connections being made through a separate node common to each set of set of inputs and outputs in each cascade, and the outputs of the last cascade, $a_{n1}$, $b_{n1}$, $c_{n1}$, . . . , $x_{n1}$, comprising multipolar, pseudo-multipolar and screw electromagnetic energies.

3. The method of claim 2 wherein said first cascade is a Lensky oscillating circuit comprising at least three induction coils ($L_1$, $L_2$, $L_3$ - - - $L_x$), wherein x=the number of induction coils, each of said coils having one end electrically connected together in one common node in a star configuration, and each opposite end to a corresponding capacitor plate in a series of capacitor plates ($C_1$, $C_2$, $C_3$ . . . $C_y$), wherein y=x and activating said circuit by completing at least three of said electrical connections, thereby generating multipolar electromagnetic energy, having a polarity equal to the number of said electrical connections, and multipolar waves, having a volume form.

4. The method of claim 1 wherein the number of induction coils (L) and capacitor plates (C) is three and the electromagnetic energy generated is tripolar.

5. The method of claim 2 wherein said electrical connections are completed via a switch, thereby allowing changing of the number of said polarities.

6. The method of claim 3 wherein said capacitor plates are electrically connected together in a single node and, upon activation of said circuit, pseudo-multipolar electromagnetic energy having a polarity equal to the number of said electrical connections, and pseudo-multipolar waves, having a pseudo-volume form, when the induction coil node and capacitor node are not connected, and a screw form, when the said nodes are connected.

7. A method according to claim 1 comprising supplying bipolar electromagnetic energy ba first set of at least four induction coils ($L_1$, $L_2$, $L_3$ . . . $L_x$), wherein x=the number of induction coils, all of said induction coils being magnetically coupled via a single spatially central-symmetrical core to a second set of the same number of induction coils ($L_{1a}$, $L_{2a}$, $L_{3a}$ . . . $L_{xa}$), each being electrically connected via one end of each coil, the other end of each coil being electrically connected to an end of a corresponding induction coil in a third identical set of induction coils ($L_{1b}$, $L_{2b}$, $L_{3b}$ . . . $L_{xb}$), said third set having the same number of coils as said second set; each of said third set induction coils being magnetically coupled to a fourth set of identical induction coils ($L_{1c}$, $L_{2c}$, $L_{3c}$ . . . $L_{xc}$) in the same said manner as said second set is connected to said first set; collecting electromagnetic energy from the other ends of said last set of induction coils, at least a portion of said collected energy comprising multipolar electromagnetic energy having a polarity equal to the number of coils in each of said sets, and separating said multipolar electromagnetic energy from said collected energy.

8. A method of claim 2 including the step of utilizing said multipolar and pseudomultipolar energy and waves, optionally after amplification, for the treatment, modification, or another manipulation of media, materials, biological objects to control the functions, energy and parameters thereof or for the creation of new materials and structures.

9. A method of claim 8 including the step of transferring the properties of said treated or modified material to electrodes through which electromagnetic energies are collected and transferred over a distance and detected with said Lensky oscillating circuits for further conversion.

10. A method of claim 8 in which said multipolar and pseudo-multipolar electromagnetic energies are utilized for computing principles, equipment and elements.

11. A method of claim 2 wherein said bipolar input comprises acoustic or mechanical oscillations or waves that have been converted to bipolar electromagnetic energy and said outputs comprise multipolar, pseudo-multipolar and screw electromagnetic energies corresponding to said oscillations and waves.

12. A method of claim 11 including the step of converting said multipolar, pseudomultipolar and screw electromagnetic energies into said oscillations and waves.

13. A method of claim 9 wherein said transferred electromagnetic energies comprise encrypted/decrypted information.

* * * * *